US009865946B2

(12) United States Patent
Miura

(10) Patent No.: US 9,865,946 B2
(45) Date of Patent: Jan. 9, 2018

(54) MOUNTING STRUCTURE OF TERMINAL ON PRINTED WIRING BOARD

(71) Applicant: YAZAKI CORPORATION, Tokyo (JP)

(72) Inventor: Kazunori Miura, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/462,770

(22) Filed: Aug. 19, 2014

(65) Prior Publication Data

US 2014/0357101 A1 Dec. 4, 2014

Related U.S. Application Data

(63) Continuation of application No. PCT/JP2013/060265, filed on Mar. 28, 2013.

(30) Foreign Application Priority Data

Mar. 29, 2012 (JP) ..... 2012-077405

(51) Int. Cl.
*H01R 12/72* (2011.01)
*H01R 12/57* (2011.01)
(Continued)

(52) U.S. Cl.
CPC ..... *H01R 12/7005* (2013.01); *H01R 4/028* (2013.01); *H01R 12/57* (2013.01);
(Continued)

(58) Field of Classification Search
CPC .... H01R 12/73; H01R 12/716; H01R 12/727; H01R 12/57; H01R 12/79; H01R 12/7005; H01R 4/028
(Continued)

(56) References Cited

U.S. PATENT DOCUMENTS 6,485,338 B1 11/2002 Wu
6,776,664 B1 * 8/2004 Huang ..... H01R 13/631 439/660
(Continued)

FOREIGN PATENT DOCUMENTS

CN 2520019 Y 11/2002
JP 2007-294299 A 11/2007
(Continued)

OTHER PUBLICATIONS

International Search Report dated Jul. 1, 2013 for International Application No. PCT/JP2013/060265 with Written Opinion of ISA.
(Continued)

*Primary Examiner* — R S Luebke
*Assistant Examiner* — Paul Baillargeon
(74) *Attorney, Agent, or Firm* — Morgan, Lewis & Bockius LLP

(57) ABSTRACT

A mounting structure includes a printed wiring board, a connector housing mounted on the printed wiring board, and a plurality of terminals retained by the connector housing. Tail surfaces of the plurality of terminals are respectively positioned opposite upper surfaces of a plurality of conductor patterns laid on the printed wiring board, and tails of the plurality of terminals are respectively soldered to the plurality of conductor patterns. The connector housing has a side surface provided with a plurality of grooves formed by partitions, and the tails of the plurality of terminals are respectively placed in the plurality of grooves, and a clearance is formed between a side surface of each tail of the plurality of terminals and a corresponding one of the partitions.

6 Claims, 5 Drawing Sheets

(51) Int. Cl.

| | |
|---|---|
| ***H01R 4/02*** | (2006.01) |
| ***H01R 12/70*** | (2011.01) |
| *H01R 12/71* | (2011.01) |
| *H01R 12/73* | (2011.01) |
| *H01R 12/79* | (2011.01) |

(52) U.S. Cl.
CPC ..... *H01R 12/716* (2013.01); *H01R 12/727* (2013.01); *H01R 12/73* (2013.01); *H01R 12/79* (2013.01)

(58) Field of Classification Search
USPC ..... 439/83, 260, 325, 541.5, 630, 733.1
See application file for complete search history.

(56) References Cited

U.S. PATENT DOCUMENTS

| | | | | |
|---|---|---|---|---|
| 7,097,482 | B1 | 8/2006 | Little et al. | |
| 7,195,498 | B1 | 3/2007 | Wang et al. | |
| 7,637,786 | B2 | 12/2009 | Hoshino et al. | |
| 7,959,450 | B1 | 6/2011 | Wang et al. | |
| 2001/0034162 | A1* | 10/2001 | Annaler ..... | H01R 13/2442 439/630 |
| 2003/0022561 | A1 | 1/2003 | Peng et al. | |
| 2008/0299796 | A1 | 12/2008 | Hoshino et al. | |
| 2009/0298343 | A1 | 12/2009 | Wu et al. | |

FOREIGN PATENT DOCUMENTS

| | | | |
|---|---|---|---|
| JP | 2008-300193 | A | 12/2008 |
| JP | 2009-176426 | A | 8/2009 |
| JP | 2011-204509 | A | 10/2011 |

OTHER PUBLICATIONS

Chinese Office Action and Search Report issued in Chinese Patent Application No. 201380017227.0 dated Nov. 25, 2015.
Japanese Office Action issued in Japanese Patent Application No. 2012-077045 dated Oct. 29, 2015.
Chinese Office Action issued in Chinese Patent Application No. 201380017227.0 dated Jun. 13, 2016.

* cited by examiner

MOUNTING STRUCTURE OF TERMINAL ON PRINTED WIRING BOARD

CROSS REFERENCE TO RELATED APPLICATIONS

This application is a continuation of PCT application No. PCT/2013/60265, which was filed on Mar. 28, 2013 based on Japanese Patent Application (No. 2012-77405) filed on Mar. 29, 2012, the contents of which are incorporated herein by reference.

BACKGROUND OF THE INVENTION

1. Field of the Invention

The present invention relates to a mounting structure of a term on a printed wiring board.

2. Description of the Related Art

With a view toward reducing a wiring space or enhancing a degree of freedom of a wiring route, a flexible intensive wire; for instance, a flexible flat cable (FFC) and a flexible wiring board (FPC: Flexible Printed Circuit), has hitherto been used for establishing an interconnection between various electronic devices or between various electric instruments. When the flexible intensive wire is connected to a printed wiring board on which various electric components are to be mounted, connectors to be electrically connected and anchored to the printed wiring board are used.

A connector of this type is made up of a connector housing that is made of a resin and into which an end of a flexible intensive wire is inserted and a plurality of terminals to be held by the connector housing. The terminals are arrayed at a predetermined pitch along a widthwise direction of the connector housing; in other words, a widthwise direction of the flexible intensive wire. When the end of the flexible intensive wire is inserted into an insertion slot on a front of the connector housing, the plurality of terminals are connected to a plurality of conductors arrayed at the end of the flexible intensive wire. Further, in the terminals, ends of the terminals pulled out of a back of the connector housing are soldered to a plurality of conductor patterns arrayed on the printed wiring board (see JP-A-2011-204509).

SUMMARY OF THE INVENTION

As mentioned above, in JP-A-2011-204509, ends of the plurality of terminals extended outside the connector housing are soldered to the conductor patterns on the printed wiring board. However, it is predicted in the future that the terminal pitch will become smaller with a progress in miniaturization of a connector and density growth of a circuit pattern. In such a case, molten solder may form a bridge between contiguous terminals or between contiguous conductor patterns, to thus form a short circuit between the terminals or conductor patterns.

An object of the present invention is to prevent occurrence of a short circuit between contiguous terminals or conductor patterns, which would otherwise be caused by molten solder when the terminals held by a connector housing are connected to the conductor patterns on a printed wiring board.

An aspect of the present invention provides a mounting structure, including: a printed wiring board; a connector housing mounted on the printed wiring board; and a plurality of terminals retained by the connector housing, wherein tail surfaces of the plurality of terminals are respectively positioned opposite upper surfaces of a plurality of conductor patterns laid on the printed wiring board, and tails of the plurality of terminals are respectively soldered to the plurality of conductor patterns, wherein the connector housing has a side surface provided with a plurality of grooves formed by partitions, and the tails of the plurality of terminals are respectively placed in the plurality of grooves, and a clearance is formed between a side surface of each tail of the plurality of terminals and a corresponding one of the partitions.

According to the configuration, even if molten solder flows around the ends of the terminals when the tails of the terminals are soldered to the conductor patterns on the printed wiring board, the clearances are formed around the respective ends of the terminals within the grooves. Hence, the solder can be guided into the clearances, where the solder can be solidified. Consequently, since the solder can be caused to stay in the grooves, flow of solder to contiguous grooves or contiguous conductor patterns can be prevented, so that occurrence of a short circuit between terminals and conductor patterns can be prevented.

The mounting structure may be configured so that the partition is formed to be jut beyond the tail of the terminal.

According to the configuration, a much larger space capable of storing molten solder can be ensured within each of the grooves; hence, outflow of solder from the grooves can be thoroughly prevented.

The mounting structure may be configured so that a bottom of the groove is formed to be smaller in width than the terminal, and the partition is formed in a trapezoidal cross sectional profile.

According to the configuration, because the terminals can be brought into contact with the slopes of the respective partitions, the terminals can be positioned within the respective grooves. Moreover, each of the terminals can be held at a predetermined position within each of the grooves. Variations in flow direction of solder which would be caused by variations in positions of the terminals can thereby be prevented, so that the solder can be caused to flow into the clearances more reliably.

The mounting structure may be configured so that a bottom surface of the groove is formed to be smaller in width than the terminal, and a step is formed on the partition to contact the tail of the terminal on the step.

According to the configuration, the terminals can be supported while remaining in contact with the steps. Consequently as in the case where each of the partitions is formed so as to assume a trapezoidal cross sectional profile, variations in flow direction of solder which would be caused by variations in positions of the terminals can thereby be prevented, so that the solder can be caused to flow into the clearances more reliably.

The present invention makes it possible to prevent a short circuit between contiguous terminals or conductor patterns, which would otherwise be caused by molten solder when the terminals held by a connector housing are connected to the conductor patterns on a printed wiring board.

DETAILED DESCRIPTION OF THE EXEMPLARY EMBODIMENTS

First Embodiment

A first embodiment of a mounting structure of a terminal on a printed wiring board (hereinafter abbreviated as a "board") of the invention is hereunder described by reference to the drawings.

Figure 4:
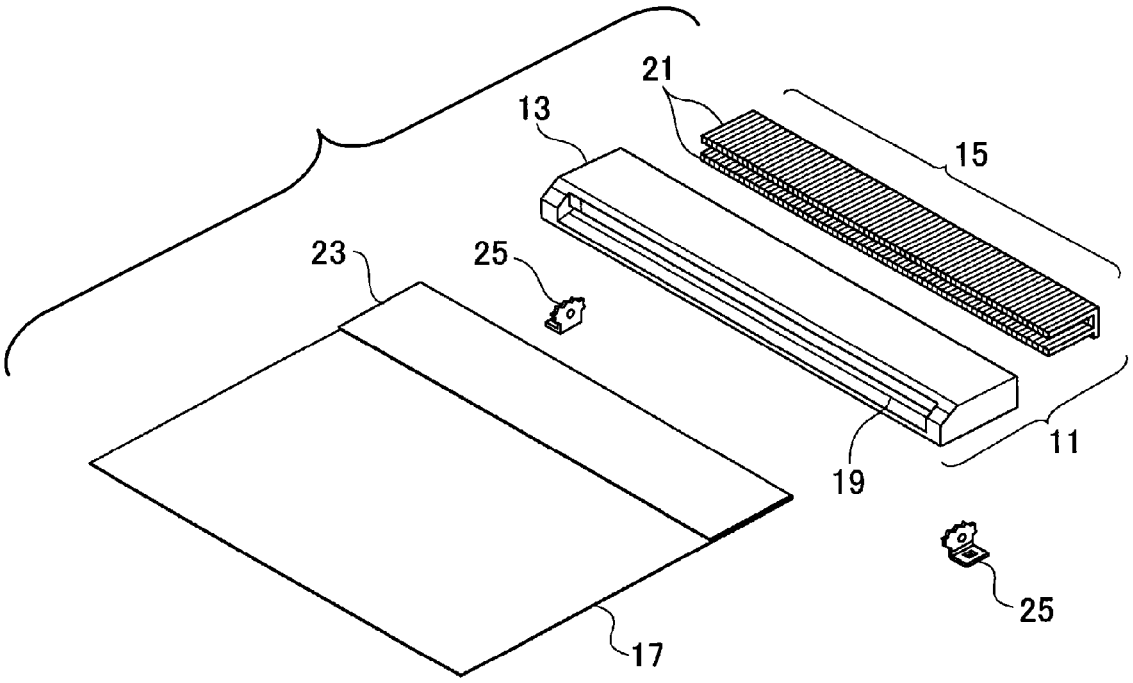
FIG. 4 is an exploded view of the connector according to the first embodiment.

FIG. 4 is an exploded perspective view of a connector to which the invention applies. As shown in FIG. 4, a connector 11 includes a connector housing 13 made of a resin and a plurality of terminals 15.

The connector housing 13 is formed into a shape of a rectangular parallelepiped whose widthwise direction is taken as a longitudinal direction. The connector housing 13 has grooves (which will be described later) into which the plurality of terminals 15 are respectively inserted and an insertion slot 19 into which a flexible intensive wire 17 is to be inserted. The insertion slot 19 is formed in one side (a front side in FIG. 4) of the connector housing 13, and the grooves are formed in the other side (a back side in FIG. 4) of the connector housing 13.

Each of the terminals 15 has a pair of mutually-opposed projections 21. Specifically, the pair of mutually-opposed projections 21 are made by letting a plate-like element protrude from one side surface of an L-shaped plate material so as to have a surface that opposes a remaining side surface of the plate material. The terminals 15 are inserted (press-fitted) into the respective grooves of the connector housing 13 while the pair of projections 21 are oriented in a direction of insertion, whereupon the terminals 15 is held by the connector housing 13.

The flexible intensive wire 17 is formed by arraying a plurality of conductors, which are in the form of a thin leaf, at a predetermined pitch in a direction orthogonal to a direction of insertion and sandwiching both sides of the conductors between insulation films. The embodiment illustrates, as an example of the flexible intensive wire 17, a flexible flat cable having an end 23 that is formed at an end in its direction of insertion by cutting an insulation film on one side (an underside in FIG. 4) of the flexible flat cable, to thus lay terminals of respective conductors bare.

The flexible intensive wire 17 is inserted, by way of the insertion slot 19, into the connector housing 13 that holds the plurality of terminals 15. At least one of the pair of projections 21 of the individual terminal 15 contacts the conductor of the end 23 of the flexible intensive wire 17.

Figure 1:
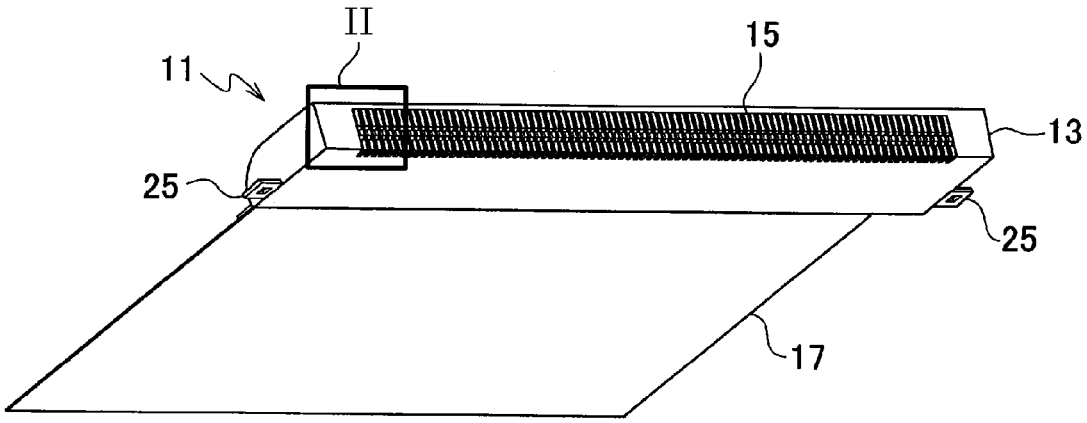
FIG. 1 is a perspective external view of a connector according to a first embodiment.

FIG. 1 is a perspective view of the connector 11 acquired when it is seen from a back side (a groove side). A fixture 25 is connected to either end of the connector housing 13 in its widthwise direction. The connector 11 is mounted on an unillustrated board, and ends of the respective terminals 15 held by the connector housing 13 are soldered to conductor patterns laid on the unillustrated board. The connector housing 13 is fixed onto the board by way of the fixtures 25. The connector 11 is thus mounted on the unillustrated board.

Figure 2:
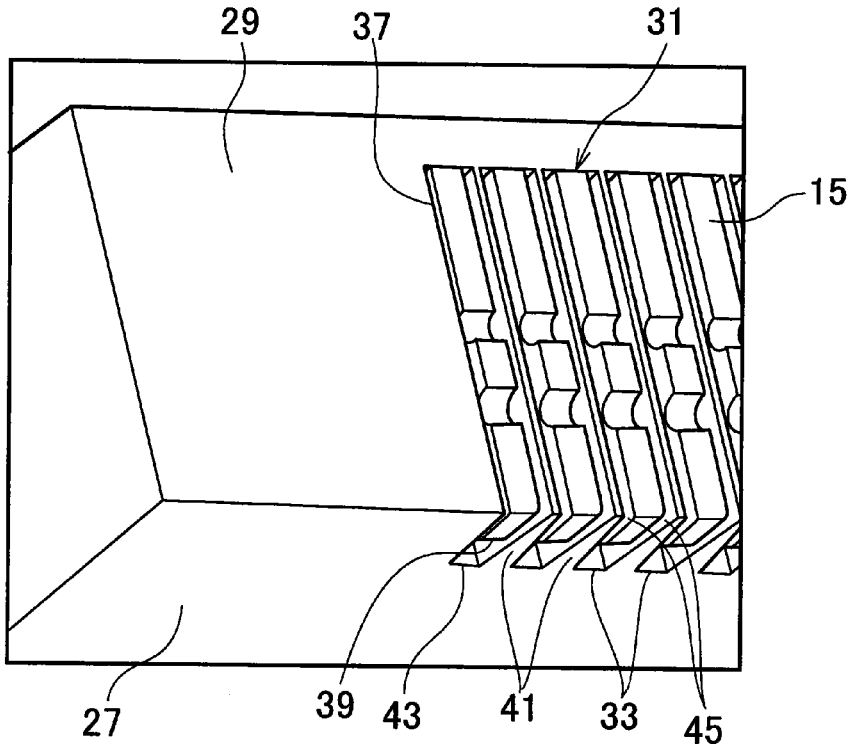
FIG. 2 is an enlarged view of an area II (a groove) shown in FIG. 1.

FIG. 2 is an enlarged view of an area II shown in FIG. 1. As shown in FIG. 2, the connector housing 13 has a plurality of grooves 31 that extend in a direction orthogonal to an undersurface 27 at a predetermined pitch along a corner where the undersurface 27 that opposes the board meets a backside 29 which stands upright from the undersurface 27.

Each of the grooves 31 has an opening 33 formed in the undersurface 27 and an opening 37 formed in the backside 29. The opening 33 is formed so as to define a cross sectional profile of the groove 31 in its depth direction. The terminal 15 is accommodated in each of the opening 37 along its longitudinal direction, and an end (hereinafter called a "tail 39") of the terminal 15 to be soldered to a conductor pattern on the board is placed in the opening 33. An unillustrated space into which the pair of projections 21 of the terminal 15 are to be accommodated is formed in the groove 31, and the groove 31 comes into mutual communication with the insertion slot 19 by way of the space.

Each of the tails 39 is formed so as to assume a rectangular cross sectional profile whose longitudinal direction is in alignment with the depth direction of the groove 31. At least two edges of the tail 39 that are situated on the backside 29 are chamfered.

The grooves 31 are partitioned off from each other by partitions 41. Specifically, the partition 41 is interposed between the contiguous grooves 31 and 31. Each of the partitions 41 is formed so as to assume a trapezoidal cross sectional profile in its depth direction, and an upper end surface of the partition 41 is in plane with the backside 29. A groove bottom surface 43 of the individual groove 31 is smaller in width than the tail 39.

Figure 3:
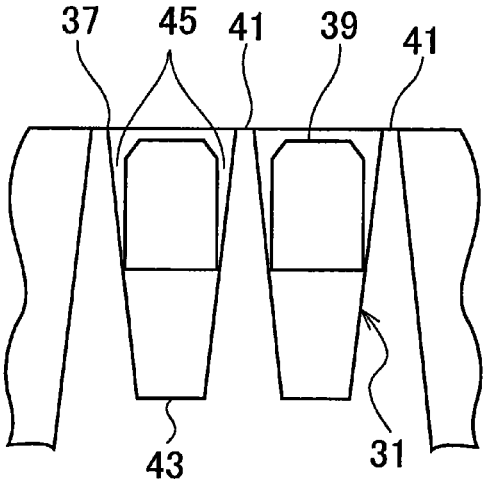
FIG. 3 is an enlarged view of a tail provided in the groove shown in FIG. 2.

FIG. 3 is an enlarged view of the opening 33 of the groove 31 formed in the undersurface 27. As shown in FIG. 3, a triangular clearance 45 is formed along a depth direction of the groove 31 between a side surface on either side of the tail 39 accommodated in the groove 31 and a slope of the partition 41 opposing the side surface.

The partition 41 is formed so as to jut beyond an upper end surface of the tail 39 in the depth direction of the groove 31. More specifically, the tail 39 stays accommodated in the corresponding groove 31 without jutting out the opening 37 of the groove 31 beyond the backside 29.

As shown in FIG. 2, each of the partitions 41 is formed so as to jut beyond the tail 39 at an end of the groove 31 in its longitudinal direction. Specifically, each of the tails 39 stays accommodated in the corresponding groove 31 without jutting from the opening 33 of the groove 31 beyond the undersurface 27.

In the embodiment, the tails 39 of the plurality of terminals 15 retained by the connector housing 13 each are positioned opposite upper surfaces of a plurality of conductor patterns laid on the board. Solder fixed to the conductor patterns becomes molten by means of for instance, a reflow technique, thereby soldering the tails 39 to the respective conductor patterns. For instance, when the tails 39 are immersed in the molten solder, the molten solder is pushed away around the tails 39. However, the tails 39 are accommodated in the respective grooves 31 (the openings 33) that oppose upper surfaces of the respective conductor patterns. Further, the clearances 45 are formed in each of the grooves 31. Consequently, the molten solder flows into the clearances 45 in each of the grooves 31, where the solder becomes solid. Therefore, since the molten solder stays in the grooves 31, where it becomes solidified, the tails 39 and the conductor patterns can be soldered to each other without fail. Moreover, because flow of the molten solder into the contiguous grooves 31 or the contiguous conductor patterns can be prevented, an occurrence of a short circuit between the contiguous terminals 15 or the contiguous conductor patterns, which would otherwise be caused by a bridge, can be hindered.

In the embodiment, each of the partitions 41 is formed so as to jut beyond the upper end surface of each of the tails 39 in the depth direction of the groove 31. Furthermore, each of the partitions 41 is formed so as to jut beyond the tail 39 at the end of the groove 31 in its longitudinal direction. Accordingly the tails 39 are fully accommodated in the respective grooves 31. This impedes the terminals 15 from directly contacting each other. In addition, the space capable of storing the molten solder can be widely assured in each of the grooves 31, and hence the solder can be reliably kept in the grooves 31.

In the embodiment, the groove bottom surface 43 of each of the grooves 31 is formed so as to become smaller in width than the corresponding terminal 15, and each of the partitions 41 is formed so as to assume a trapezoidal cross sectional profile. Hence, the edges of each of the tails 39 can be placed while remaining in contact with the respective slopes of the partitions 41. The tails 39 can thereby be positioned in the respective grooves 31. Further, each of the tails 39 can be held at a predetermined position in each of the grooves 31. Consequently, variations in flow direction of solder which would be caused by variations in positions of the tails 39 can be prevented, on that the solder can be caused to flow into the clearances 45 more reliably.

Incidentally if the terminals 15 become smaller in the future as a result of miniaturization of the connector 11, an area of a connection between the tails 39 and the conductor patterns on the board will become smaller, and the amount of solder used for the connection between the tails and the conductor patterns will also be reduced. This may cause deterioration of electrical conduction. In this regard, however, a short circuit between terminals or between conductor patterns, which would otherwise occur when the tails 39 are soldered to the conductor patterns, can be prevented in the embodiment. Therefore, even if the area of the connection between the tails 39 and the conductor patterns becomes smaller, a comparatively large amount of solder can be used, so that deterioration of electrical conduction can be prevented.

Second Embodiment

A second embodiment of a mounting structure of a terminal on a board of the invention is hereunder described by reference to the drawings. The mounting structure of the terminal on the board of the second embodiment is analogous to its counterpart described in connection with the first embodiment unless otherwise specified.

Figure 5:
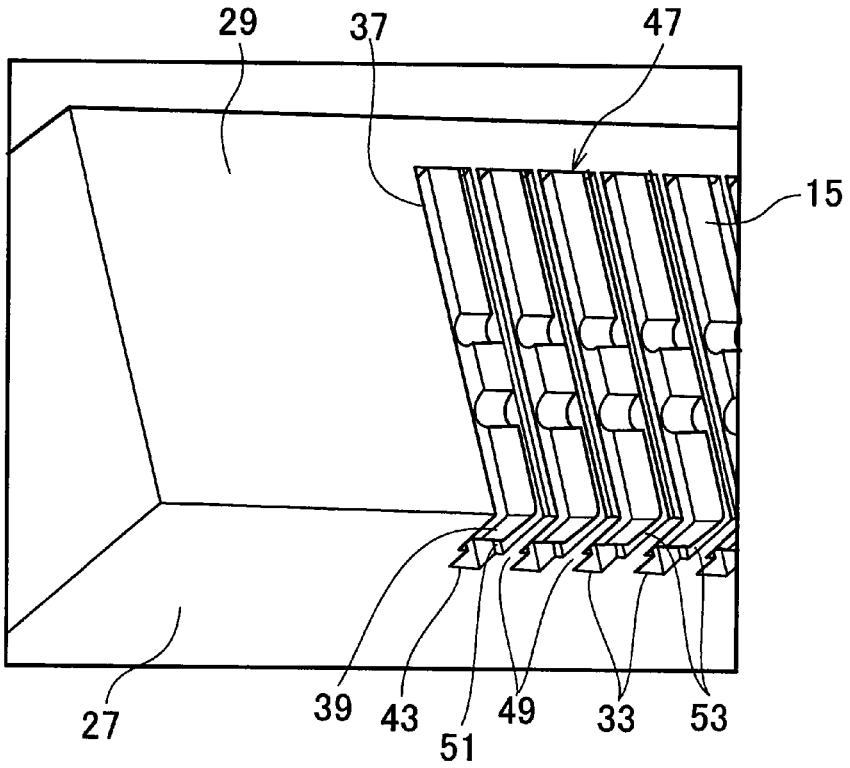
FIG. 5 is an enlarged view of a groove of a connector according to a second embodiment.

FIG. 5 is an enlarged view of an example of a groove in the mounting structure of the terminal on the board according to the second embodiment. As shown in FIG. 5, the groove bottom surface 43 of each of grooves 47 is smaller in width than each of the terminals 15. Further, each of partitions 49 assumes a stepped shape in which steps 51 that the terminals 15 are to contact are formed on both sides of the partition 49. Further, clearances 53 each of which assumes a rectangular cross sectional profile are formed in a depth direction of the groove 47 between side surfaces of the tail 39 to be accommodated in each of the grooves 47 and the partitions 49 opposing the respective side surfaces.

As above, even when the partitions 49 are formed into a stepped shape instead of the trapezoidal shape, the molten solder flows and becomes solidified in the clearances 53 when the tails 39 are soldered to the conductor patterns. Therefore, as in the case of the first embodiment, the molten solder stays and becomes solidified in the grooves 47, so that the tails 39 and the conductor patterns can reliably be soldered to each other. Moreover, flow of the molten solder to the contiguous grooves 47 or between the contiguous conductor patterns can be hindered. This therefore can impede occurrence of a short circuit between the contiguous terminals 15 or the contiguous conductor patterns, which would otherwise be caused by a bridge.

Since the steps 51 are formed on each of the partitions 49, the tails 39 can be placed while remaining in contact with the steps 51. The tails 39 can thereby be positioned within the respective grooves 47, and the tails 39 can be also held at predetermined positions within the respective grooves 47. As a consequence, as in the case with the first embodiment, variations in flow direction of solder which would be caused by variations in positions of the tails 39 can be prevented, so that the solder can be caused to flow into the clearances 53 more reliably.

Although the embodiments of the present invention have been described in detail thus far by reference to the drawings, the embodiments are mere illustrations of the present invention, and the present invention shall not be restricted solely to the configurations described in connection with the embodiments. As a matter of course, even when alterations are made to the design of the present invention without departing the gist of the present invention, the alterations are included in the present invention.

For instance, explanations have been given to the connector 11 for connecting the flexible intensive wire 17 to the terminals 15 in the embodiments. However, the connector is not limited to those described in connection with the embodiments. In a word, the present invention can be applied to any connector, so long as the connector holds a plurality of terminals to be soldered to conductor patterns arrayed on a board.

According to the present invention, it is possible to provide a mounting structure that prevents a short circuit between contiguous terminals or conductor patterns, which would otherwise be caused by molten solder when the terminals held by a connector housing are connected to the conductor patterns on a printed wiring board.

What is claimed is:

1. A mounting structure, comprising:

a connector housing having an insertion slot and a plurality of grooves formed by partitions, opposing to the insertion slot in a first direction, wherein the insertion slot communicates with the plurality of grooves;

a flexible wire having an end portion that is inserted into the insertion slot of the connector housing; and a plurality of terminals inserted into the plurality of grooves and retained by the connector housing, the terminals including projections extending along the first direction in the connector housing and having one ends connected to the end portion of the flexible wire and tails extending from other ends of the projections along a second direction perpendicular to the first direction in the plurality of grooves of the connector housing, wherein each of the plurality of grooves includes a first portion and a second portion provided along the second direction, wherein the first portion communicates with the insertion slot, and the second portion receives an end portion of the tail of the terminal and ends at a bottom surface of the each of the plurality of grooves formed to be smaller in width than the terminal, and a clearance is formed between a side surface of each tail of the plurality of terminals and a corresponding one of the partitions on a side of the second portion such that the clearance is able to receive solder flowing from the tails so that the solder stays in corresponding grooves.

2. The mounting structure according to claim 1, wherein the partitions are each formed to be just beyond the tail of the terminal.

3. The mounting structure according to claim 1, wherein the partitions are each formed in a trapezoidal cross sectional profile.

4. The mounting structure according to claim 1, wherein a step is formed on each of the partitions to contact the tail of the terminal on the step.

5. The mounting structure according to claim 1, wherein the tails of the plurality of terminals are placed in the plurality of grooves, respectively.

6. The mounting structure according to claim 1, wherein each of the tails of the plurality of terminals contacts the corresponding one of the partitions opposite to the bottom surface of the each of the plurality of grooves in the first direction.

* * * * *